US009222433B2

(12) United States Patent
Falkowski et al.

(10) Patent No.: US 9,222,433 B2
(45) Date of Patent: Dec. 29, 2015

(54) GENSET FUEL INJECTION SYSTEM

(75) Inventors: David T. Falkowski, Blaine, MN (US); Stephen M. Clancey, Mounds View, MN (US); Keith M. Schorr, Summerville, SC (US); Charlotte E. Wiley, Maple Grove, MN (US); Jeffrey D. Peterson, St. Paul, MN (US)

(73) Assignee: CUMMINS POWER GENERATION IP, INC., Minneapolis, MN (US)

( * ) Notice: Subject to any disclaimer, the term of this patent is extended or adjusted under 35 U.S.C. 154(b) by 1027 days.

(21) Appl. No.: 13/285,664

(22) Filed: Oct. 31, 2011

(65) Prior Publication Data

US 2013/0104851 A1 May 2, 2013

(51) Int. Cl.

| | |
|---|---|
| ***F02M 37/00*** | (2006.01) |
| ***F02D 41/32*** | (2006.01) |
| *F02M 37/08* | (2006.01) |

(Continued)

(52) U.S. Cl.

CPC ..... *F02D 41/32* (2013.01); *F02D 29/06* (2013.01); *F02M 37/007* (2013.01); *F02M 37/0047* (2013.01); *F02M 37/0088* (2013.01); *F02M 37/08* (2013.01); *F02M 37/10* (2013.01); *F02M 37/106* (2013.01)

(58) Field of Classification Search

CPC ... F02M 25/0809; F02M 37/00; F02M 37/20; F02M 37/0047; F02M 37/08; F02M 37/0088; F02M 37/106; F02D 29/06; F02D 41/32; B60K 2015/03138

USPC ..... 123/446, 510, 511, 515, 516, 517, 509; 137/255, 263, 571, 572

See application file for complete search history.

(56) References Cited

U.S. PATENT DOCUMENTS

| | | | | |
|---|---|---|---|---|
| 3,884,255 | A * | 5/1975 | Merkle | 137/265 |
| 5,119,790 | A | 6/1992 | Olson | |
| 5,135,024 | A * | 8/1992 | LeBlanc et al. | 137/529 |

(Continued)

FOREIGN PATENT DOCUMENTS

| | | |
|---|---|---|
| WO | WO2006/005930 | 1/2006 |
| WO | WO2011/051949 | 5/2011 |

OTHER PUBLICATIONS

International Search Report and Written Opinion of the International Search Report for PCT/US2012/062555, dated Feb. 8, 2013, 15 pages.

(Continued)

*Primary Examiner* — Erick Solis
*Assistant Examiner* — Anthony L Bacon
(74) *Attorney, Agent, or Firm* — Foley & Lardner LLP

(57) ABSTRACT

An apparatus includes a recreational vehicle genset having an engine and a generator. The apparatus includes a fuel injection system having a primary fuel reservoir, a secondary fuel reservoir, and a fill pump that receives fuel from a primary fuel reservoir and is fluidly coupled to the secondary fuel reservoir at the pump outlet. The apparatus includes a reservoir fuel indicator that provides a fuel amount signal corresponding to the fuel in the secondary fuel reservoir, and a pressure regulator that relieves pressure in the secondary fuel reservoir at a threshold relief pressure. The apparatus includes an injection pump that provides pressurized fuel from the secondary fuel reservoir to a fuel injector for the engine. The apparatus further includes a controller having a pump regulation module that interprets the fuel amount signal, and that selectively provides a fill pump operation command in response to the fuel amount signal.

24 Claims, 5 Drawing Sheets

(51) Int. Cl.
*F02M 37/10* (2006.01)
*F02D 29/06* (2006.01)

(56) References Cited

U.S. PATENT DOCUMENTS

| | | | | |
|---|---|---|---|---|
| 5,465,703 | A | 11/1995 | Abe | |
| 5,873,347 | A | 2/1999 | Kato et al. | |
| 6,076,509 | A | 6/2000 | Kyuma | |
| 6,166,525 | A | 12/2000 | Crook | |
| 6,230,484 | B1 | 5/2001 | Kerns | |
| 6,279,310 | B1 | 8/2001 | Strand et al. | |
| 6,508,265 | B1 * | 1/2003 | Bertouille et al. | 137/256 |
| 6,557,533 | B2 | 5/2003 | Katayama et al. | |
| 6,581,579 | B1 | 6/2003 | Knight et al. | |
| 6,758,191 | B2 | 7/2004 | Vanderveen et al. | |
| 6,772,739 | B2 | 8/2004 | Veinotte et al. | |
| 7,005,756 | B2 | 2/2006 | Westerbeke, Jr. | |
| 7,013,878 | B1 | 3/2006 | Cotton et al. | |
| 7,047,949 | B2 | 5/2006 | Reiter et al. | |
| 7,114,491 | B2 | 10/2006 | Hamada et al. | |
| 7,146,968 | B2 | 12/2006 | Koito et al. | |
| 7,168,414 | B2 | 1/2007 | Harvey | |
| 7,188,610 | B2 | 3/2007 | Crary et al. | |
| 7,802,562 | B2 * | 9/2010 | Lippa et al. | 123/577 |
| 8,049,607 | B2 * | 11/2011 | Usukura et al. | 340/450.3 |
| 8,807,258 | B2 * | 8/2014 | Stansbury, III | 180/165 |
| 2003/0172912 | A1 * | 9/2003 | Kanai et al. | 123/520 |
| 2004/0003796 | A1 | 1/2004 | Nomura | |
| 2005/0022584 | A1 * | 2/2005 | De Ronne et al. | 73/49.7 |
| 2006/0260387 | A1 | 11/2006 | Baillargeon et al. | |
| 2007/0101974 | A1 | 5/2007 | Achor | |
| 2007/0169842 | A1 * | 7/2007 | King | 141/302 |
| 2010/0281856 | A1 | 11/2010 | Sakakibara et al. | |

OTHER PUBLICATIONS

Notification Concerning Transmittal of International Preliminary Report on Patentability, dated May 15, 2014 for PCT/US2012/062555, 12 pages.

* cited by examiner

GENSET FUEL INJECTION SYSTEM

BACKGROUND

Gensets are used extensively in recreational vehicle (RV) applications. Presently available genset fueling systems have several challenges within an RV application. A genset in an RV application will typically not have a dedicated fuel source available, and will utilize whatever fuel is used by the RV or that is otherwise available on the RV. For example, the genset may utilize the fuel for the primary motive engine for the RV, or fuel from propane tanks that are available on the RV. A high number of interfaces (mechanical, fluid, and electrical) between the genset and the RV create challenges in packaging, compatibility, service, and maintenance. For example, having both a feed line and a return line to the fuel source creates a more complex interface between the genset and the RV than having only a feed line. A genset in an RV application may experience long periods without use, after which the user nevertheless expects the genset will easily start and operate with minimal exertion. The use of gensets with other applications can present similar challenges to the use of a genset with an RV application. Therefore, further technological developments are desirable in this area.

SUMMARY

One embodiment is a unique apparatus for fueling an engine of a genset. Other embodiments include unique methods, systems, and apparatus to fuel an engine of a genset in a recreational vehicle application. Further embodiments, forms, objects, features, advantages, aspects, and benefits shall become apparent from the following description and drawings.

DESCRIPTION OF THE ILLUSTRATIVE EMBODIMENTS

Figure 1:
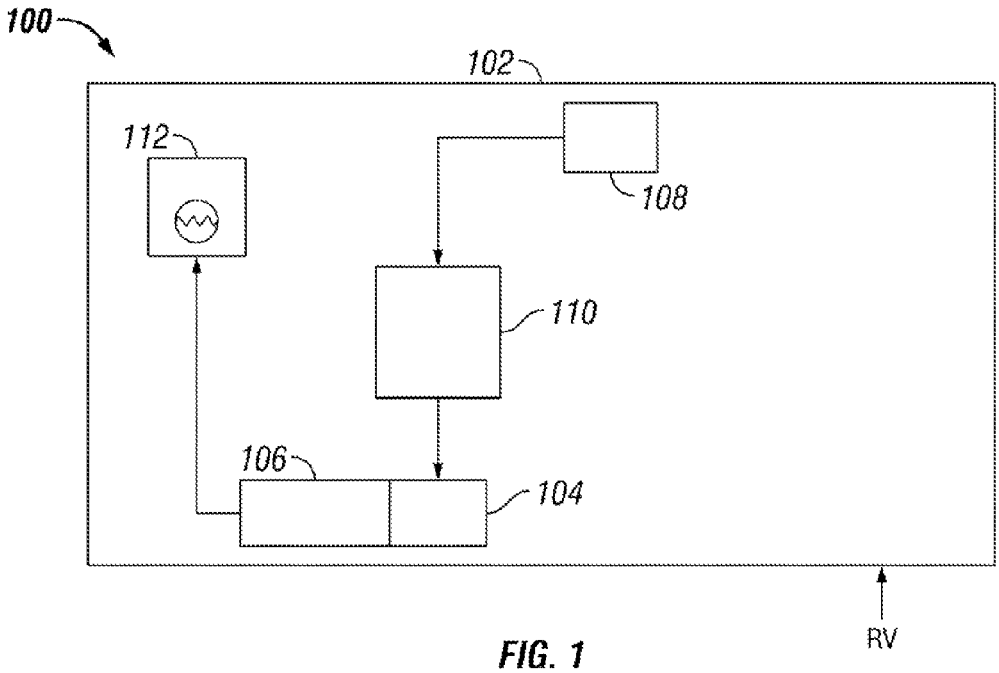
FIG. 1 is a schematic diagram of a system including a genset and a genset fueling system.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referencing FIG. 1, a system 100 includes a fuel injection system 110 for a genset in a recreational vehicle (RV) 102. In one form, RV 102 is of an on-road, fifth wheel type that includes one or more electrical appliances or other electric loads for which it would be desirable to provide power with the genset. The corresponding RV electrical system may further accommodate shore power commonly available to such arrangements. In other embodiments, the type and nature of the RV and/or genset application may differ.

The system 100 incudes an RV genset having an engine 104 and an electric power generator 106. The engine 104 is of an internal combustion type having one or more reciprocating pistons and one or more corresponding fuel injectors. Engine 104 provides rotational mechanical power to generator 106. In one arrangement, generator 106 is of a permanent magnet alternator (PMA) type mounted directly on the drive shaft of engine 104. In other forms, generator 106 can be mechanically coupled to engine 104 by a mechanical linkage that provides a desired turn ratio, a torque converter, a transmission, and/or a different form of rotary linking mechanism as would occur to those skilled in the art; and further generator 106 may be of a different type other than a PMA. In still other arrangements, engine 104 may be of a different kind other than a reciprocating piston type and/or another type of motive power may be provided for generator 106.

The system 100 further includes a primary fuel reservoir 108 for the RV 102. The primary fuel reservoir 108 may be a fuel tank utilized by the primary motive engine (not shown) for the RV 102, one or more liquefied petroleum (LP) tanks available on the RV 102 (e.g. propane tanks), or other primary fuel reservoir 108 included on the RV 102. The system 100 includes an electrical load 112 that is to be powered at least partially and/or intermittently by the genset. Exemplary loads 112 includes lighting, entertainment devices, power receptacles for various plug-in devices, air conditioning, or the like for the RV 102, however any load 112 known in the art is contemplated herein.

Figure 2:
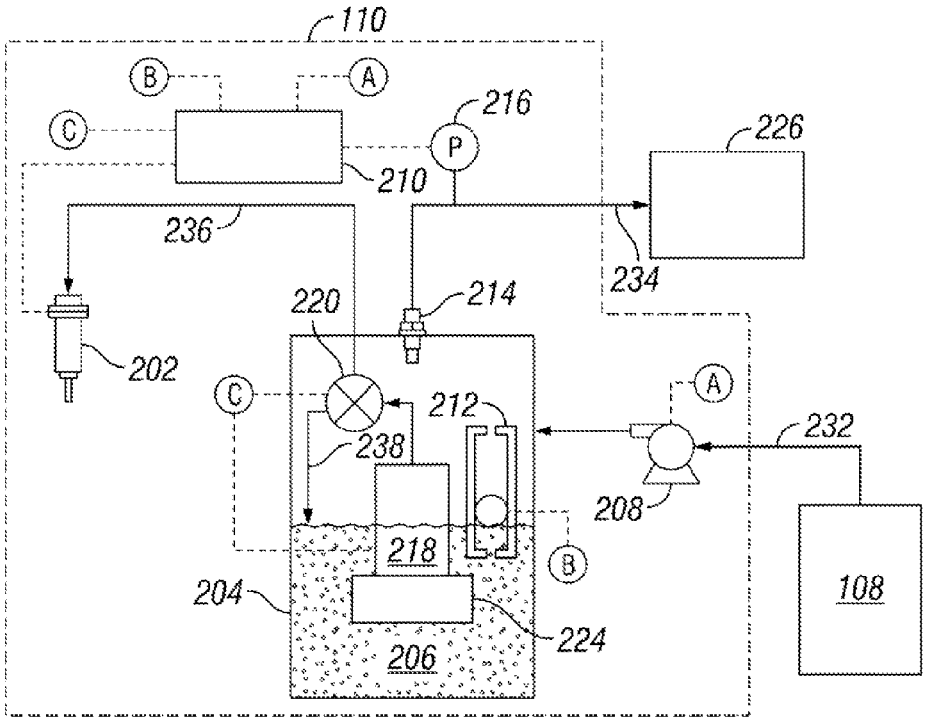
FIG. 2 is a schematic diagram of a genset fueling system.

Referencing FIG. 2, an exemplary fuel injection system 110 usable in a system 100 is illustrated. The fuel injection system 110 includes a secondary fuel reservoir 206. The fuel injection system 110 further includes a fill pump 208 fluidly coupled to the primary fuel reservoir 108 on an upstream side of the pump 208 and fluidly coupled to the secondary fuel reservoir 206 on a downstream side of the pump 208. During operation, the fill pump 208 transfers fuel from the primary fuel reservoir 108 to the secondary fuel reservoir 206. Where the fuel in the primary fuel reservoir 108 is LP, the fill pump 208 draws vapor off the primary fuel reservoir 108. One of skill in the art will recognize that a total amount of LP fuel deliverable by the fuel injection system 110 to the engine 104 is limited by the vapor generation rate of the fuel in the primary fuel reservoir 108, and aspects of the system 100 should be sized accordingly. Where the fuel provided by the fuel injection system 110 is a liquid (e.g. gasoline or diesel), the total amount of fuel provided by the fuel injection system 110 is generally not limited by a delivery rate of fuel from the primary fuel reservoir 108.

An exemplary fuel in the secondary fuel reservoir is gasoline, which may include additives, ethanol, and/or E85 (85% ethanol-gasoline blend). In certain embodiments, the fuel may be diesel. Another exemplary embodiment includes the fuel as gaseous LP or compressed natural gas (CNG), removed as vapor from the primary fuel reservoir. LP, as used herein, includes any low molecular weight fuel that is liquefied at storage temperatures and pressures in the primary fuel reservoir, including at least propane, butane, and mixtures of similar molecular weight hydrocarbon molecules.

The fuel injection system 110 further includes a pump regulator that selectively operates the fill pump 208 in response to an amount of fuel in the secondary fuel reservoir 206. An exemplary pump regulator includes a float valve 212 that provides a varying electronic response at one or more fill levels of the secondary fuel reservoir 206—for example a logical ON value when the till level is low and a logical OFF value when the fill level is high. An exemplary float valve 212 is hardwired to the fill pump 208 and directly operates the fill pump 208. Ordinary interlock features understood in the art may be included—for example the fill pump 208 may be disabled when the engine 104 is not operating or is powered down, and/or the fill pump 208 may be disabled when certain fuel injection system 110 faults are active.

Another exemplary pump regulator includes the float valve 212 providing a varying electronic response to a controller 210. The varying electronic response may be a binary response—e.g. below a fill level versus at or above the fill level, or the varying electronic response may be a number of discrete fill values (e.g. the float in the float valve 212 makes various electrical connections depending upon the current fluid level) or a continuously varying electrical response (e.g. a resistance value changes with the level of the float in the float valve 212). The controller 210 interprets the varying electronic response and operates the fill pump 208 according to predetermined logic based upon the varying electronic response. In certain embodiments, the controller 210 may operate the fill pump 208 when the fill level in the secondary fuel reservoir 206 is below a threshold fill level and/or may vary the operating speed of the fill pump 208 in response to a current fill level and/or a rate of change in the current fill level.

Another exemplary pump regulator includes the float valve 212 that provides a fill signal in response to the amount of fuel in the secondary fuel reservoir 206, being less than a threshold fill level. The fill pump 208 operates in response to the fill signal. In a further embodiment, the fuel injection system 110 includes the controller 210 receiving the fill signal and providing a fill pump operation command in response to the fill signal. The fill pump 208 is responsive to the fill pump operation command to deliver fuel from the primary fuel reservoir 108 to the secondary fuel reservoir 206.

In a further embodiment, the controller 210 determines the float valve 212 is failed in response to the float valve 212 not providing the fill signal for a threshold reservoir empty time. The threshold reservoir empty time is determined while the injection pump 218 is in operation, and is determined according to the flow rate of the injection pump 218 and the storage volume of the secondary fuel reservoir 206. Additionally or alternatively, the controller 210 determines that the float valve 212 is failed in response to the float valve 212 providing the fill signal for longer than a threshold reservoir fill time. The threshold reservoir fill time is determined while the fill pump 208 is in operation, and is determined according to the flow rate of the fill pump 208 and the storage volume of the secondary fuel reservoir 206.

The fuel injection system 110 further includes a pressure regulator that relieves pressure in the secondary fuel reservoir 206 at a threshold relief pressure. The pressure regulator may operate with hardware or be operated by the processing subsystem. For example, the pressure regulator may include a relief valve 214 that automatically opens at a predetermined vapor pressure in the secondary fuel reservoir 206. Another exemplary pressure regulator includes the controller 210 that interprets a vapor pressure in the secondary fuel reservoir 206 from a pressure sensor 216, and controllably opens the relief valve 214 at a predetermined vapor pressure.

The predetermined vapor pressure, or relief pressure, of the pressure regulator is selected according to the fuel and the application. For example, a relief pressure of about 10 psi is sufficient for most gasoline applications. An application where gasoline is present in a high ambient temperature environment, and where the gasoline is not a low vapor pressure summer formulation, the relief pressure may be set higher than 10 psi. Where the fuel is LP, the relief pressure is set according to the amount of fuel that is to be stored in the secondary fuel reservoir, and the inlet pressure requirement for the injection pump. The relief pressure for a fuel injection system 110 where the fuel is LP may be 10 psi or significantly higher, depending upon the volume of the secondary fuel reservoir 206 and the amount of fuel that is designed to be stored in the secondary fuel reservoir 206 during operations of the fuel injection system 110.

The fuel injection system 110 further includes an injection pump 218 that provides pressurized fuel from the secondary fuel reservoir 206 to the fuel injector 202 of the engine 104. The injection pump 218 is designed to have a high enough pressure outlet to meet the specifications of the fuel injector 202 inlet pressure requirement. The specific value required for the fuel injector 202 depends upon the hardware utilized in the specific application, and is generally available from the manufacturer of the fuel injector 202 or otherwise known to one of skill in the art. The injection pump 218 draws fuel from the secondary fuel reservoir 206. The fuel injection system 110 may further include a fuel filter 224 positioned between the fuel stored in the secondary fuel reservoir 206 and an inlet of the injection pump 218.

The exemplary fuel injection system 110 further includes a housing 204 defining the secondary fuel reservoir 206 and the injection pump 218 within the housing 204. The exemplary fuel injection system 110 further includes a recirculation line 238 within the housing 204, where the recirculation line 238 fluidly couples a fluid outlet 236 of the injection pump 218 to the secondary fuel reservoir 206. Without limitation, the recirculation line 238 provides for the injection pump 218 to be operated at a higher rate than the demands of the fuel injector 202, allowing fuel to be available from a continuous pump 218 during the discrete injection operations of the fuel injector 202. The recirculation line 238 also allows the fuel injector system 110 to be responsive to fueling rate changes from the fuel injector 202, and allows the injection pump 218 to maintain prime while the fuel injection system 110 is operating. Fluid flow through the recirculation line 238 and through the fluid outlet 236 of the injection pump 218 to the fuel injector 202 is controlled by a flow regulator 220 that may be a 3-way valve or other hardware structured to controllably divide flow from the injection pump 218.

In certain embodiments, the fuel is gasoline and the fuel injection system 110 further includes a three-way valve 220 fluidly disposed between the injection pump 218 and the fuel injector 202. The three-way valve 220 is fluidly coupled to the injection pump 218 on an upstream side of the valve 220 and fluidly coupled to the fuel injector 202 on a downstream side of the valve 220. In a further embodiment, the relief valve 214 of the pressure regulator is a rollover valve that prevents fluids from passing through the valve when the valve orientation is upside down past horizontal. Further, in certain embodiments, the rollover valve allows vapor to pass through the valve 214 when opened but prevents liquid from passing through the valve 214. The rollover valve 214 prevents residual liquid fuel from spilling from the secondary fuel reservoir 206 during certain activities that may change the orientation of the fuel injection system 110, e.g. during maintenance events.

The fuel injection system 110 includes a fuel inlet 232 from the primary fuel reservoir 108. The fuel injection system 110 further includes a vapor outlet 234, which may be provided to the engine 104 air intake 226 and/or to the engine 104 intake manifold (not shown).

Figure 3:
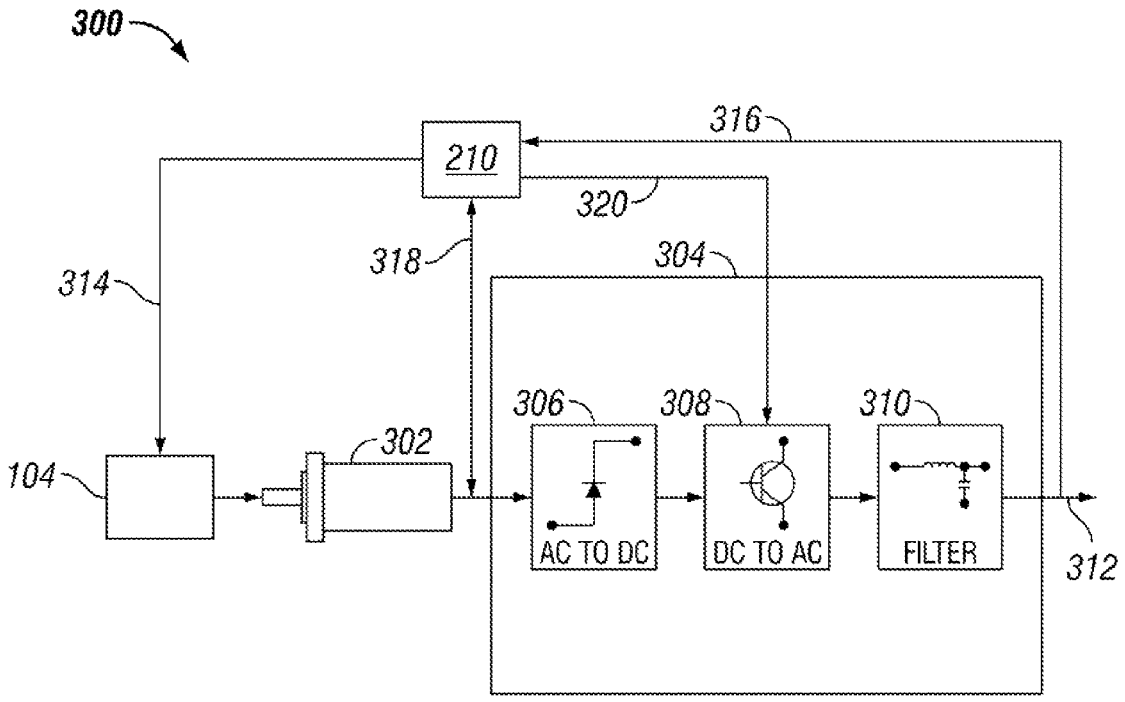
FIG. 3 is a schematic diagram of a genset including an engine and an inverter.

Referencing FIG. 3, a genset 300 is shown that is usable in the system 100. The genset 300 includes the generator having a generator 302 and an inverter 304. The generator 302 provides an alternating current output in response to rotation from the engine 104. As is known in the art, the generator 302 can be configured with the proper combination of the stator, rotor, and armature windings to generate electricity in response to rotational power input. The generated electricity may be single phase, but typically includes a multiple phase output. The generated Alternating Current (AC) output electricity from the generator 302 may be usable directly in some embodiments of the present application; however, the illustrated embodiment of the present application contemplates use of a variable speed arrangement that is subjected to further conditioning to provide a desired fixed frequency AC electric power output.

An exemplary processing from an inverter 304 includes a rectifier 306 to convert the generated electricity to a DC output, and a DC to AC inverter 308 that converts the DC output to an AC output having the desired phase and amplitude. An exemplary DC to AC inverter 308 includes field effect transistors (FETs), and the FET inverter 308 allows the controller 210 to issue commands 320, e.g. pulse-width modulated (PWM) voltage commands, to schedule the desired phase and amplitude of AC output. Because a digitally generated AC output from an FET inverter 308 can include discrete voltage step effects, the inverter 304 may further include a filter 310 to smooth out the voltage steps into a clean AC electrical output 312. The filter 310 is illustrated as an LC filter.

The controller 210 is in communication with any device in the genset 300 as required to perform described operations. Exemplary communications include engine communications 314, generator 302 output communications 318, commands 320 to the DC to AC inverter 308, and feedback detection 316 of the electrical output 312. The illustration including a generator 302 and subsequent processing is exemplary only. Any electrical generation scheme from the engine 104 known in the art is contemplated herein, and certain processing steps may be substituted or omitted depending upon the desired form of the electrical output 312 for the genset.

In certain embodiments, the system 100 includes the controller 210 structured to perform certain operations to provide fuel to a fuel injector for a genset engine. An exemplary controller 210 is illustrated as part of the fuel injection system 110. However, the controller 210 may reside with a second controller (not shown) on the engine 104, or be distributed across various devices in the system 100. Controller 210 executes operating logic that defines various control, management, and/or regulation functions. This operating logic may be in the form of dedicated hardware, such as a hardwired state machine, programming instructions, and/or a different form as would occur to those skilled in the art. Controller 210 may be provided as a single component, or a collection of operatively coupled components; and may be comprised of digital circuitry, analog circuitry, or a hybrid combination of both of these types. When of a multi-component form, controller 210 may have one or more components remotely located relative to the others. Controller 210 can include multiple processing units arranged to operate independently, in a pipeline processing arrangement, in a parallel processing arrangement, and/or such different arrangement as would occur to those skilled in the art. In one embodiment, controller 210 is a programmable microprocessing device of a solid-state, integrated circuit type that includes one or more processing units and memory. Controller 210 can include one or more signal conditioners, modulators, demodulators, Arithmetic Logic Units (ALUs), Central Processing Units (CPUs), limiters, oscillators, control clocks, amplifiers, signal conditioners, filters, format converters, communication ports, clamps, delay devices, memory devices, and/or different circuitry or functional components as would occur to those skilled in the art to perform the desired communications. In one form, controller 210 includes a computer network interface to facilitate communications the using the industry standard Controller Area Network (CAN) communications among various system components and/or components not included in the depicted system, as desired.

Figure 4:
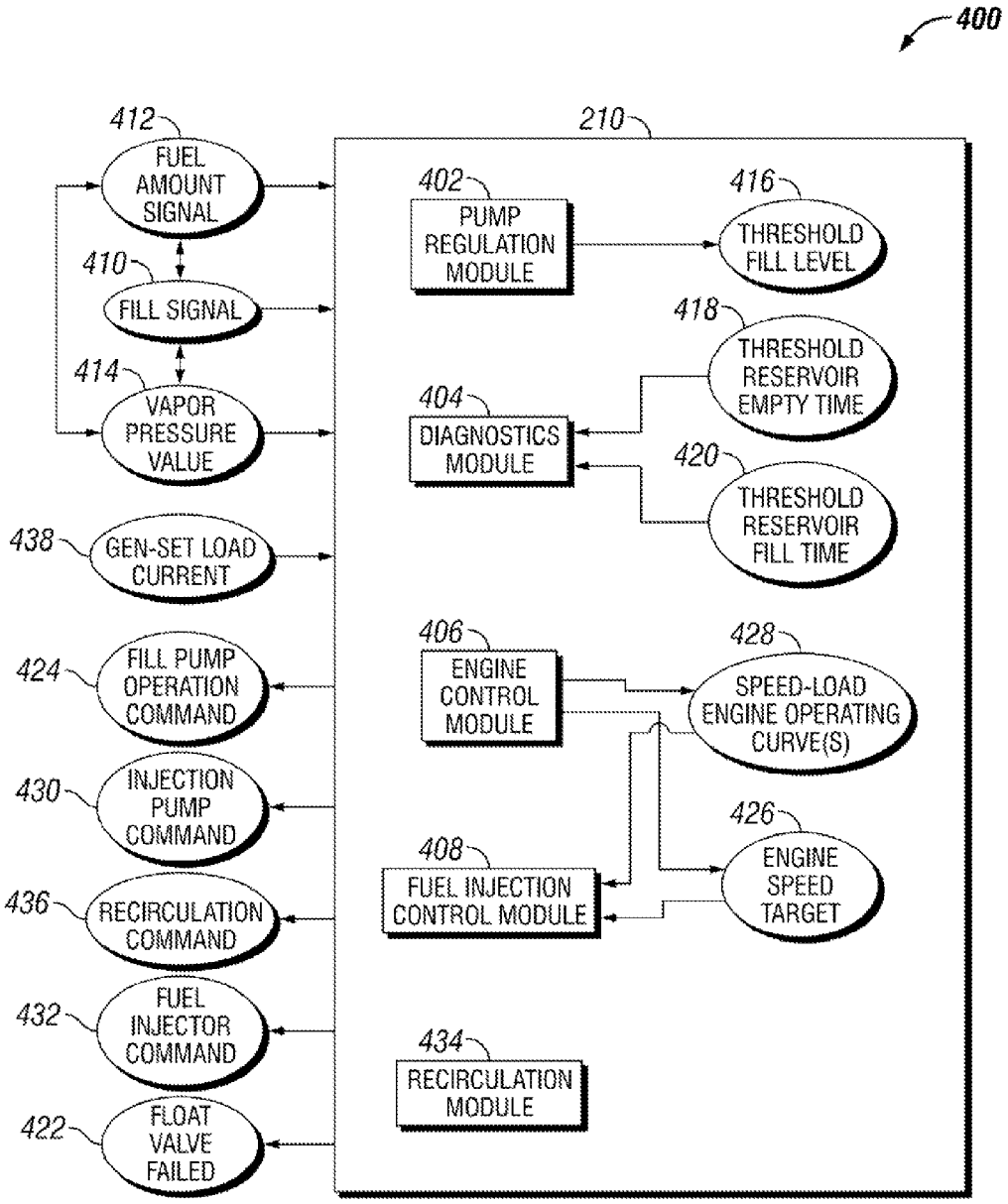
FIG. 4 is a schematic diagram of a processing subsystem for controlling a genset fueling system.

In certain embodiments, the controller 210 includes one or more modules structured to functionally execute the operations of the controller. Referencing FIG. 4, an exemplary controller 210 includes a pump regulation module 402, a diagnostics module 404, an engine control module 406, a fuel injection control module 408, and a recirculation module 434. It is understood that certain embodiment of the controller 210 may not include one or more of the modules.

The description herein including modules emphasizes the structural independence of the aspects of the controller 210, and illustrates one grouping of operations and responsibilities of the controller 210. Other groupings that execute similar overall operations are understood within the scope of the present application. Modules may be implemented in hardware and/or software on computer readable medium, and modules may be distributed across various hardware or software components. Where a description includes interpreting a data value, the interpreting includes, without limitation, reading the value from a memory location, receiving the value over a datalink, receiving the value as a physical value (e.g. a voltage reading from a sensor), and/or calculating the value from one or more other parameters.

An exemplary controller 210 includes the pump regulation module 402 that interprets the fuel amount signal 412, and selectively provides a fill pump operation command 424 in response to the fuel amount signal 412.

The exemplary controller 210 includes the engine control module 406 that determines a genset load current 438, and further determines an engine speed target 426 in response to the genset load current 438. In one example, at a defined voltage output, the genset load current 438 defines the power output of the electrical output 312 (reference FIG. 3), and at a fixed engine load value the engine speed target 426 defines the engine power to achieve the defined power output. The fuel injection control module 408 provides an injection pump command 430 and a fuel injector command 432 in response to the engine speed target 426. The fuel injector command 432 is determined according to a current fueling amount for the engine 104 that is required to achieve the engine speed target 426, and/or that is required to progress acceptably toward the engine speed target 426 during a transient event. The injection pump command 430 is determined according to a fuel output of the injection pump required to maintain the design pressure at the fuel injector and/or to progress acceptably toward the design pressure at the fuel injector.

Figure 5:
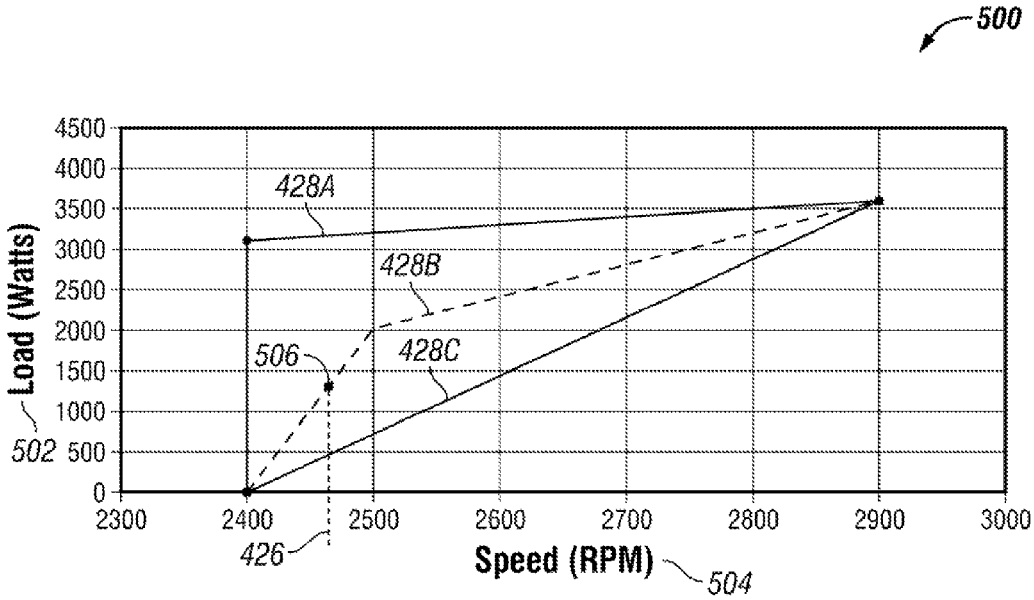
FIG. 5 is an illustration of a number of speed-load engine operating curves.

In a further embodiment, the engine control module 406 further selects a speed-load engine operating curve 428, and the fuel injection control module 408 further provides the injection pump command and the fuel injector command in response to the speed-load engine operating curve 428. For example, referencing FIG. 5, an illustration 500 of a number of speed-load engine operating curves 428A, 428B, 428C are shown. The curves 428A, 428B, 428C are plotted against an engine load 502 axis and an engine speed 504 axis. The exemplary curve 428A is illustrative of a maximum fuel efficiency curve for an exemplary engine, and the exemplary curve 428C is illustrative of a linear speed-load curve for an exemplary engine. The linear speed-load curve 428C provides a smooth engine response to power output changes. An intermediate speed-load curve 428B that provides some fuel economy and smooth engine response benefits. In the example, the engine control module 406 selects the current speed-load curve (428B in the example), and the engine speed target 426, thereby providing the engine operating point 506 including the current engine load target.

The illustrated curves 428A, 428B, 428C are exemplary and non-limiting. A curve 428 may be defined according to any criteria understood in the art, including at least maximizing fuel economy, maximizing engine exhaust temperatures, minimizing engine exhaust temperatures, minimizing noise output, minimizing operation at certain engine speed values, and/or minimizing engine noise during power output transients. Likewise, the selection of a speed-load curve 428 from a number of available speed-load curves 428 may be made according to any criteria understood in the art, including without limitation a current ambient temperature value, a determination of whether the RV is moving, a determination of whether the RV prime motive engine is operating, the magnitude of electrical output power requested, the variability in the electrical output power requested, and/or according to an operator selection input. An exemplary embodiment includes a number of speed-load engine operating curves 428 stored on the controller 210, for example at a time of manufacture, and the engine control module 406 determines which of the stored curves 428 to utilize according to current operating conditions. However, any method of providing speed-load engine operating curves 428 to the engine control module 406 during run-time of the controller 210 is contemplated herein.

The exemplary controller 210 further includes the diagnostics module 404 that determines whether the float valve is failed, and provides a float valve failed 422 indicator. An exemplary diagnostics module 404 determines the float valve is failed in response to the float valve not providing the fill signal for a threshold reservoir empty time 418, and/or in response to the float valve providing the fill signal for longer than a threshold reservoir fill time 420. The threshold reservoir empty time 418 may be predetermined or calculated during operations, and is determined based on the flow rate of the injection pump and the storage volume of the secondary fuel reservoir.

The diagnostics module 404 may set the float valve failed 422 indicator before the secondary fuel reservoir is expected to be emptied, and/or may delay setting the float valve failed 422 indicator for a period of time after the secondary fuel reservoir is expected to be emptied. The threshold reservoir fill time 420 may be predetermined or calculated during operations, and is determined based on the flow rate of the fill pump and the storage volume of the secondary fuel reservoir. The diagnostics module 404 may set the float valve failed 422 indicator before the secondary fuel reservoir is expected to be filled, and/or may delay setting the float valve failed 422 indicator for a period of time after the secondary fuel reservoir is expected to be filled. In response to the float valve failed 422 indicator, the system 100 may provide the fault indicator to a fault handling system for display or other action as is known in the art. Further, an exemplary pump regulation module 402 disables the fill pump in response to the float valve failed 422 indicator.

The exemplary controller 210 further includes a recirculation module 434 that provides a recirculation command 436 to recirculate an amount of pressurized fuel form the injection pump to the secondary fuel reservoir. The recirculation module 434 determines the recirculation command 436 in response to the pressure requirement at the fuel injector and the current output pressure and flow of the injection pump.

Another exemplary embodiment includes a reservoir fuel indicator. An exemplary reservoir fuel indicator is a float valve that provides the fuel amount signal 412 to the controller 210 in response to an amount of fuel in the secondary fuel reservoir. Another exemplary reservoir fuel indicator is a float valve that provides the fuel amount signal 412 as a fill signal 410 in response to the amount of fuel in the secondary fuel reservoir being less than a threshold fill level 416. Another exemplary reservoir fuel indicator includes the fuel as a gaseous LP fuel, and a pressure sensor provides the fuel amount signal 412 to the controller 210 as a vapor pressure value 414. Yet another exemplary reservoir fuel indicator includes the fuel as a gaseious LP fuel, and a pressure sensor provides the fuel amount signal 412 to the controller 210 as a fill signal 410 determined according to a vapor pressure value 414 of the secondary fuel reservoir being less than the threshold fill level 416.

The following description provides an illustrative embodiment of performing procedures for providing fuel to a genset. Operations illustrated are understood to be exemplary only, and operations may be combined or divided, and added or removed, as well as re-ordered in whole or part, unless stated explicitly to the contrary herein. Certain operations illustrated may be implemented by a computer executing a computer program product on a computer readable medium, where the computer program product comprises instructions causing the computer to execute one or more of the operations, or to issue commands to other devices to execute one or more of the operations.

An exemplary procedure includes an operation to determine the amount of fuel in the secondary fuel reservoir by interpreting a fill signal provided by a float valve. The exemplary procedure further includes an operation to determine the float valve is failed in response to the float valve not providing the fill signal for a threshold reservoir empty time, and/or in response to the float valve providing the fill signal for longer than a threshold reservoir fill time.

Yet another exemplary procedure includes the fuel being a gaseous LP, where the operation to determine the amount of fuel in the secondary fuel reservoir includes an operation to determine a vapor pressure value of the secondary fuel reservoir. Another exemplary procedure includes the fuel being a gaseous LP, where the operation to determine the amount of fuel in the secondary fuel reservoir includes an operation to determine a fill signal in response to a vapor pressure value of the secondary fuel reservoir being less than a threshold fill level.

Another exemplary procedure includes an operation to determine a genset load current, an operation to determine an engine speed target in response to the genset load current, and an operation to provide the pressurized fuel in response to the engine speed target. The exemplary procedure further includes an operation to determine a fuel injector command for the fuel injector in response to the engine speed target. A further embodiment includes an operation to select a speed-load engine operating curve, and an operation to provide the pressurized fuel in response to the speed-load engine operating curve. Additionally or alternatively, the procedure includes an operation to determine the fuel injector command in response to the speed-load engine operating curve.

Figure 6:
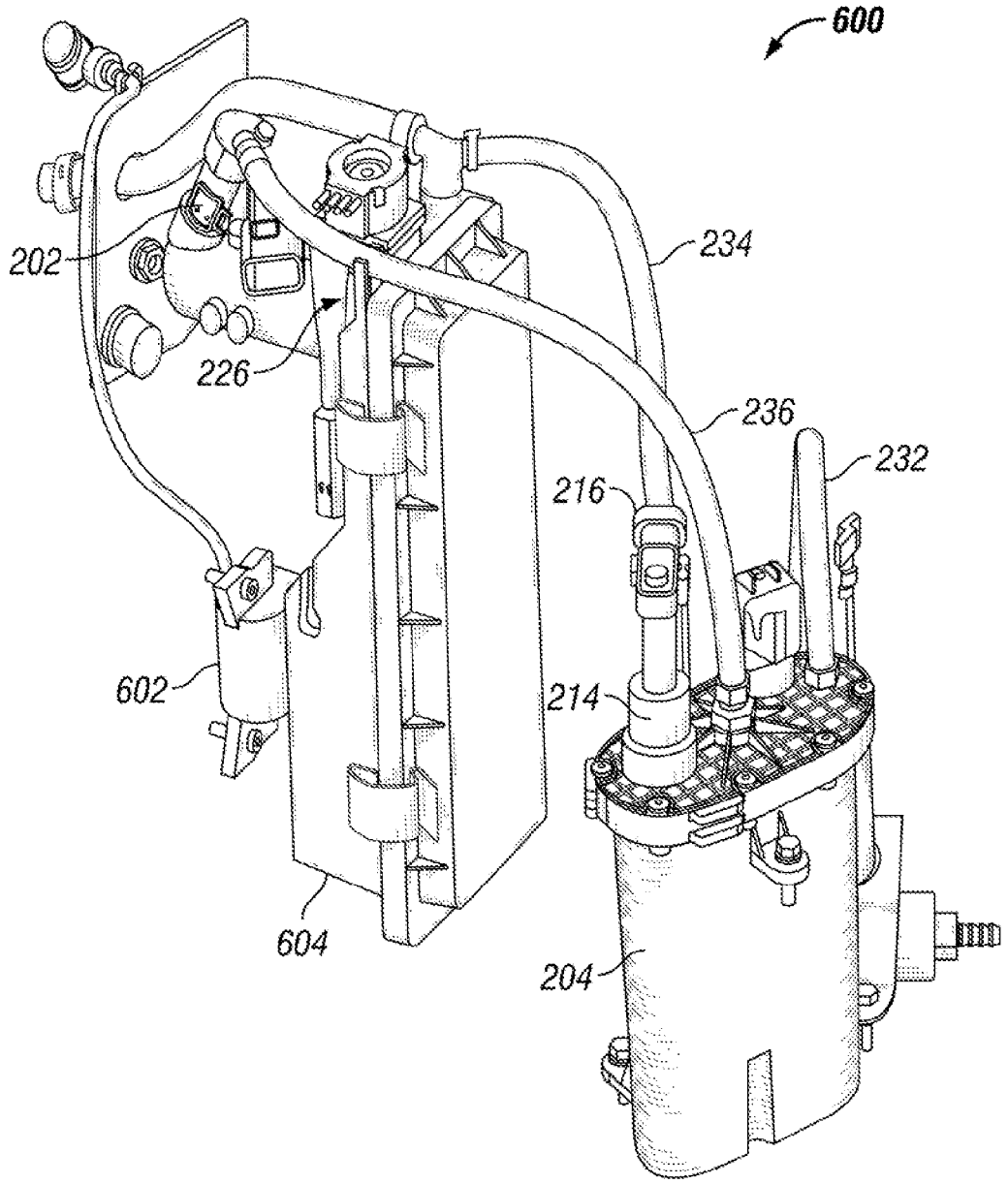
FIG. 6 is a perspective illustration of a genset fueling system.

Referencing FIG. 6, a perspective illustration of packaging an embodiment of a fuel injection system 600 is provided. The fuel injection system 600 includes the housing 204, having a secondary fuel reservoir and injection pump therein (not shown). A fuel inlet 232 enters the housing 204, and the injection pump outlet 236 passes to a fuel injector 202 for the engine. The fuel injection system 600 further includes a rollover valve 214 and a pressure sensor 216. The pressure sensor 216 is shown past the valve 214 and does not measure pressure in the secondary fuel reservoir 206 before the valve 214 opens. Alternatively, the pressure sensor 216 may be positioned before the valve 214, and/or additional pressure sensors may be positioned within the housing if the fuel injection system 600 includes a controller that determines the pressure within the secondary fuel reservoir. The fuel injection system further includes an air filter box 604 that provides mounting positions for various components including an ignition coil 602. The fuel injection system 600 further includes the vapor outlet 234 that passes into the engine air intake 226 before entering the engine intake manifold. The arrangement illustrated in FIG. 6 is illustrative and non-limiting.

As is evident from the figures and text presented above, a variety of embodiments according to the present invention are contemplated.

An exemplary embodiment is an apparatus including a recreational vehicle genset having an engine and a generator, where the engine includes a fuel injector. The apparatus further includes a fuel injection system including a primary fuel reservoir for the RV, and a secondary fuel reservoir. In certain embodiments, the primary fuel reservoir for the RV includes a gasoline tank or a liquefied petroleum (LP) tank.

The system includes a fill pump fluidly coupled to the primary fuel reservoir on an upstream side of the pump and fluidly coupled to the secondary fuel reservoir on a downstream side of the pump. The operating fuel pump transfers fuel from the primary fuel reservoir to the secondary fuel reservoir.

The system further includes a pump regulator that selectively operates the fill pump in response to an amount of fuel in the secondary fuel reservoir.

An exemplary pump regulator includes a float valve that provides a varying electronic response at one or more fill levels of the secondary fuel reservoir—for example a logical ON value when the fill level is low and a logical OFF value when the fill level is high. An exemplary float valve is hardwired to the fill pump and directly operates the fill pump. Another exemplary float valve provides the varying electronic response to a controller that interprets the varying electronic response and operates the fill pump according to predetermined logic based upon the varying electronic response.

The system further includes a pressure regulator that relieves pressure in the secondary fuel reservoir at a threshold relief pressure. The pressure regulator may operate with hardware or be operated by the processing subsystem. For example, the pressure regulator may include a relief valve that automatically opens at a predetermined vapor pressure in the secondary fuel reservoir. Another exemplary pressure regulator includes a controller that interprets a vapor pressure in the secondary fuel reservoir from a pressure sensor, and controllably opens a relief valve at a predetermined vapor pressure. The system further includes an injection pump that provides pressurized fuel from the secondary fuel reservoir to the fuel injector of the engine.

In certain embodiments, the system further includes the generator being of a PMA type. The generator provides an alternating current output in response to rotation from the engine. Before powering a load, the output of the generator may be further conditioned as understood in the art. For example, the output of the generator may be rectified and provided as a DC current, and/or further inverted into a clean sinusoidal AC output from the genset.

An exemplary fuel in the secondary fuel reservoir is gasoline, which may include additives, ethanol, and/or E85 (85% ethanol-gasoline blend). In certain embodiments, the fuel may be diesel. Another exemplary embodiment includes the fuel as gaseous LP or compressed natural gas (CNG), removed as vapor from the primary fuel reservoir. LP, as used herein, includes any low molecular weight fuel that is liquefied at storage temperatures and pressures in the primary fuel reservoir, including at least propane, butane, and mixtures of similar molecular weight hydrocarbon molecules.

The relief pressure of the pressure regulator is selected according to the fuel and the application. For example, a relief pressure of about 10 psi is sufficient for most gasoline applications. An application where gasoline is present in a high ambient temperature environment, and where the gasoline is not a low vapor pressure summer formulation, the relief pressure may be set higher than 10 psi. Where the fuel is LP, the relief pressure is set according to the amount of fuel that is to be stored in the secondary fuel reservoir, and the inlet pressure requirement for the injection pump. The relief pressure for a system where the fuel is LP may be 10 psi or significantly higher.

In certain embodiments, the fuel is gasoline and the system further includes a three-way valve fluidly disposed between the injection pump and the fuel injector. The three-way valve is coupled to the injection pump on an upstream side of the valve and to the fuel injector on a downstream side of the valve. In a further embodiment, the pressure regulator includes a rollover valve that allows vapor to pass when opened but prevents liquid from passing. The rollover valve prevents residual liquid fuel from spilling from the secondary fuel reservoir during certain activities such as maintenance events.

In certain embodiments, the pump regulator includes a float valve that provides a fill signal in response to the amount of fuel being less than a threshold fill level. The fill pump operates in response to the fill signal. In a further embodiment, the system includes the controller receiving the fill signal and providing a fill pump operation command in response to the fill signal. In a further embodiment, the controller determines the float valve is failed in response to the float valve not providing the fill signal for a threshold reservoir empty time. The threshold reservoir empty time is determined while the injection pump is in operation, and is determined according to the flow rate of the injection pump and the storage volume of the secondary fuel reservoir. Additionally or alternatively, the controller determines that the float valve is failed in response to the float valve providing the fill signal for longer than a threshold reservoir fill time. The threshold reservoir fill time is determined while the fill pump is in operation, and is determined according to the flow rate of the fill pump and the storage volume of the secondary fuel reservoir.

Another exemplary embodiment is an apparatus including a recreational vehicle genset having an engine and a generator, the engine having a fuel injector. The apparatus includes a fuel injection system having a secondary fuel reservoir and a fill pump that receives fuel from a primary fuel reservoir for a recreational vehicle (RV) and fluidly coupled to the secondary fuel reservoir on a downstream side. The apparatus further includes a reservoir fuel indicator that provides a fuel amount signal in response to an amount of fuel in the secondary fuel reservoir. An exemplary reservoir fuel indicator is a float valve, where the fuel amount signal is a fill signal in response to the amount of fuel being less than a threshold fill level.

A further embodiment includes a controller having a diagnostics module that determines the float valve is failed in response to the float valve not providing the fill signal for a threshold reservoir empty time, or in response to the float valve providing the fill signal for longer than a threshold reservoir fill time. In another exemplary embodiment, the fuel is gaseous LP and the reservoir fuel indicator is a vapor pressure value of the secondary fuel reservoir, and/or a fill signal provided in response to the vapor pressure value of the secondary fuel reservoir being less than a threshold fill level.

The apparatus further includes a pressure regulator that relieves pressure in the secondary fuel reservoir at a threshold relief pressure, and an injection pump that provides pressurized fuel from the secondary fuel reservoir to a fuel injector of an engine of a genset for the RV. The apparatus further includes the controller having a pump regulation module that interprets the fuel amount signal, and selectively provides a fill pump operation command in response to the fuel amount signal. An exemplary embodiment further includes the controller having an engine control module that determines a genset load current, and further determines an engine speed target in response to the genset load current. The exemplary controller further includes a fuel injection control module that provides an injection pump command and a fuel injector command in response to the engine speed target. In a still further embodiment, the engine control module further selects a speed-load engine operating curve, and the fuel injection control module further provides the injection pump command and the fuel injector command in response to the speed-load engine operating curve.

An exemplary apparatus further includes a housing defining the secondary fuel reservoir and the injection pump within the housing. The exemplary apparatus further includes a recirculation line within the housing, where the recirculation line fluidly couples an outlet of the injection pump to the secondary fuel reservoir.

Yet another exemplary embodiment is a method for providing fuel to a fuel injector of a genset. The method includes carrying a genset including a fuel injection system with a recreational vehicle. The fuel injection system includes a primary fuel reservoir, a secondary fuel reservoir, and a fuel injector. The method includes determining an amount of fuel in the secondary fuel reservoir, and in response to the amount of fuel being less than a threshold fill level, transferring fuel from the primary fuel reservoir to the secondary fuel reservoir. The method further includes providing pressurized fuel from the secondary fuel reservoir to a fuel injector for a genset, and relieving pressure in the secondary fuel reservoir in response to the pressure in the secondary fuel reservoir exceeding a threshold relief pressure. An exemplary method further includes recirculating an amount of the pressurized fuel to the secondary fuel reservoir. A further embodiment includes not returning any fuel from the secondary fuel reservoir to the primary fuel reservoir.

An exemplary method includes determining the amount of fuel in the secondary fuel reservoir by interpreting a fill signal provided by a float valve. The exemplary method further includes determining the float valve is failed in response to the float valve not providing the fill signal for a threshold reservoir empty time, and/or in response to the float valve providing the fill signal for longer than a threshold reservoir fill time.

Yet another exemplary method includes the fuel being a gaseous LP, where determining the amount of fuel in the secondary fuel reservoir includes determining a vapor pressure value of the secondary fuel reservoir. Another exemplary method includes the fuel being a gaseous LP, where determining the amount of fuel in the secondary fuel reservoir includes determining a fill signal in response to a vapor pressure value of the secondary fuel reservoir being less than a threshold fill level.

An exemplary method includes determining a genset load current, determining an engine speed target in response to the genset load current, and providing the pressurized fuel in response to the engine speed target. The exemplary method further includes determining a fuel injector command for the fuel injector in response to the engine speed target. A further embodiment includes selecting a speed-load engine operating curve, and providing the pressurized fuel in response to the speed-load engine operating curve. Additionally or alternatively, the method includes determining the fuel injector command in response to the speed-load engine operating curve.

While the invention has been illustrated and described in detail in the drawings and foregoing description, the same is to be considered as illustrative and not restrictive in character, it being understood that only certain exemplary embodiments have been shown and described and that all changes and modifications that come within the spirit of the inventions are desired to be protected. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus, comprising:

a recreational vehicle genset comprising an engine and a generator, the engine having a fuel injector;

a fuel injection system, including:

a primary fuel reservoir;

a secondary fuel reservoir;

a fill pump fluidly coupled to the primary fuel reservoir on an upstream side and fluidly coupled to the secondary fuel reservoir on a downstream side, the fill pump configured to transfer fuel from the primary fuel reservoir to the secondary fuel reservoir when an amount of fuel in the secondary fuel reservoir is below a threshold fill level;

a pump regulator structured to selectively operate the fill pump in response to an amount of fuel in the secondary fuel reservoir, the pump regulator comprising a float valve structured to provide a fill signal in response to the amount of fuel being less than a threshold fill level, and wherein the fill pump operates in response to the fill signal;

a pressure regulator structured to relieve pressure in the secondary fuel reservoir at a threshold relief pressure;

an injection pump structured to provide pressurized fuel from the secondary fuel reservoir to the fuel injector; and a controller structured to receive the fill signal and to provide a fill pump operation command in response to the fill signal, the controller further structured to determine that the float valve is failed in response to the float valve providing the fill signal for longer than a threshold reservoir fill time.

2. The apparatus of claim 1, wherein the generator is of a PMA type.

3. The apparatus of claim 1, further comprising an on-road recreational vehicle carrying the genset and the fuel injection system.

4. The apparatus of claim 3, further comprising a three-way valve fluidly coupled to the injection pump on an upstream side and fluidly coupled to the fuel injector on a downstream side.

5. The apparatus of claim 3, wherein the pressure regulator comprises a rollover valve.

6. The apparatus of claim 1, wherein the controller is further structured to determine that the float valve is failed in response to the float valve not providing the fill signal for a threshold reservoir empty time.

7. The apparatus of claim 1, wherein the primary fuel reservoir for the RV comprises one of a gasoline tank and a liquefied petroleum tank.

8. An apparatus, comprising: a recreational vehicle genset comprising an engine and a generator, the engine having a fuel injector;

a fuel injection system, including:

a secondary fuel reservoir;

a fill pump structured to receive fuel from a primary fuel reservoir for a recreational vehicle (RV) and fluidly coupled to the secondary fuel reservoir on a downstream side, the fill pump configured to transfer fuel from the primary fuel reservoir to the secondary fuel reservoir when an amount of fuel in the secondary fuel reservoir is below a threshold fill level;

a reservoir fuel indicator structured to provide a fuel amount signal in response to an amount of fuel in the secondary fuel reservoir, the reservoir fuel indicator comprising a float valve, the fuel amount signal comprising a fill signal in response to the amount of fuel being less than a threshold fill level;

a pressure regulator structured to relieve pressure in the secondary fuel reservoir at a threshold relief pressure;

an injection pump structured to provide pressurized fuel from the secondary fuel reservoir to a fuel injector of an engine of a genset for the RV; and a controller, comprising a pump regulation module structured to interpret the fuel amount signal, and to selectively provide a fill pump operation command in response to the fuel amount signal, the controller further comprising a diagnostics module structured to determine the float valve is failed in response to the float valve providing the fill signal for longer than a threshold reservoir fill time.

9. The apparatus of claim 8, wherein the controller further comprises a diagnostics module structured to determine the float valve is failed in response to the float valve not providing the fill signal for a threshold reservoir empty time.

10. The apparatus of claim 8, wherein the amount of fuel comprises a gaseous liquefied petroleum fuel, and wherein the reservoir fuel indicator comprises one of:

a vapor pressure value of the secondary fuel reservoir; and a fill signal in response to the vapor pressure value of the secondary fuel reservoir being less than the threshold fill level.

11. The apparatus of claim 8, wherein the controller further comprises an engine control module structured to determine a genset load current and to determine an engine speed target in response to the genset load current, the controller further comprising a fuel injection control module structured to provide an injection pump command and a fuel injector command in response to the engine speed target.

12. The apparatus of claim 11, wherein the engine control module is further structured to select a speed-load engine operating curve, and wherein the fuel injection control module is further structured to provide the injection pump command and the fuel injector command in response to the speed-load engine operating curve.

13. The apparatus of claim 8, further comprising a housing defining the secondary fuel reservoir and the injection pump, the apparatus further comprising a recirculation line within the housing, wherein the recirculation line fluidly couples an outlet of the injection pump to the secondary fuel reservoir.

14. A method, comprising:

carrying a genset including a fuel injection system with a recreational vehicle, the fuel injection system including a primary fuel reservoir, a secondary fuel reservoir, and a fuel injector;

determining an amount of fuel in the secondary fuel reservoir, wherein the determining the amount of fuel in the secondary fuel reservoir comprises interpreting a fill signal provided by a float valve;

in response to the amount of fuel being less than a threshold fill level, transferring fuel from the primary fuel reservoir to the secondary fuel reservoir;

providing pressurized fuel from the secondary fuel reservoir to the fuel injector;

relieving pressure in the secondary fuel reservoir in response to the pressure in the secondary fuel reservoir exceeding a threshold relief pressure; and determining the float valve is failed in response to the float valve providing the fill signal for longer than a threshold reservoir fill time.

15. The method of claim 14, further comprising recirculating an amount of the pressurized fuel to the secondary fuel reservoir.

16. The method of claim 15, wherein no fuel is returned from the secondary fuel reservoir to the primary fuel reservoir.

17. The method of claim 14, further comprising determining the float valve is failed in response to the float valve not providing the fill signal for a threshold reservoir empty time.

18. The method of claim 14, wherein the amount of fuel comprises a gaseous liquefied petroleum, and wherein the determining the amount of fuel in the secondary fuel reservoir comprises determining a vapor pressure value of the secondary fuel reservoir.

19. The method of claim 14, wherein the amount of fuel comprises a gaseous liquefied petroleum, and wherein the determining the amount of fuel in the secondary fuel reservoir comprises determining a fill signal in response to a vapor pressure value of the secondary fuel reservoir being less than a threshold fill level.

20. The method of claim 14, further comprising determining a genset load current, determining an engine speed target in response to the genset load current, wherein the providing the pressurized fuel further comprises providing the pressurized fuel in response to the engine speed target.

21. The method of claim 20, further comprising determining a fuel injector command in response to the engine speed target.

22. The method of claim 21, further comprising selecting a speed-load engine operating curve, wherein the providing the pressurized fuel further comprises providing the pressurized fuel in response to the speed-load engine operating curve, and wherein the determining the fuel injector command further comprises determining the fuel injector command in response to the speed-load engine operating curve.

23. An apparatus, comprising:

a recreational vehicle genset comprising an engine and a generator, the engine having a fuel injector;

a fuel injection system, including:

a primary fuel reservoir;

a secondary fuel reservoir;

a fill pump fluidly coupled to the primary fuel reservoir on an upstream side and fluidly coupled to the secondary fuel reservoir on a downstream side;

a pump regulator structured to selectively operate the fill pump in response to an amount of fuel in the secondary fuel reservoir, the pump regulator comprising a float valve structured to provide a fill signal in response to the amount of fuel being less than a threshold fill level, and wherein the fill pump operates in response to the fill signal;

a pressure regulator structured to relieve pressure in the secondary fuel reservoir at a threshold relief pressure;

an injection pump structured to provide pressurized fuel from the secondary fuel reservoir to the fuel injector; and a controller structured to receive the fill signal and to provide a fill pump operation command in response to the fill signal, the controller further structured to determine that the float valve is failed in response to the float valve providing the fill signal for longer than a threshold reservoir fill time.

24. An apparatus, comprising: a recreational vehicle genset comprising an engine and a generator, the engine having a fuel injector;

a fuel injection system, including:

a secondary fuel reservoir;

a fill pump structured to receive fuel from a primary fuel reservoir for a recreational vehicle (RV) and fluidly coupled to the secondary fuel reservoir on a downstream side;

a reservoir fuel indicator structured to provide a fuel amount signal in response to an amount of fuel in the secondary fuel reservoir, the reservoir fuel indicator comprising a float valve, the fuel amount signal comprising a fill signal in response to the amount of fuel being less than a threshold fill level;

a pressure regulator structured to relieve pressure in the secondary fuel reservoir at a threshold relief pressure;

an injection pump structured to provide pressurized fuel from the secondary fuel reservoir to a fuel injector of an engine of a genset for the RV; and a controller, comprising a pump regulation module structured to interpret the fuel amount signal, and to selectively provide a fill pump operation command in response to the fuel amount signal, the controller further comprising a diagnostics module structured to determine the float valve is failed in response to the float valve providing the fill signal for longer than a threshold reservoir fill time.

* * * * *